US006050664A

United States Patent [19]

Wilson, II

[11] Patent Number: 6,050,664

[45] **Date of Patent: *Apr. 18, 2000**

[54] ADJUSTABLE SLIDE MOUNT FOR INK JET PRINT HEAD

[75] Inventor: James D. Wilson, II, Collinsville, Ill.

[73] Assignee: Marsh Company, Belleville, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/728,774

[22] Filed: Oct. 11, 1996

[51] Int. Cl.[7] ..... B41J 25/308

[52] U.S. Cl. ..... 347/8; 400/56

[58] Field of Search ..... 347/8, 5, 1, 4, 347/20, 2; 209/3.3; 400/55, 56; 384/49, 50, 54, 57

[56] References Cited

U.S. PATENT DOCUMENTS

| | | |
|---|---|---|
| 4,378,564 | 3/1983 | Cross et al. . |
| 4,792,817 | 12/1988 | Barney . |
| 4,814,795 | 3/1989 | Kuester et al. . |
| 4,923,311 | 5/1990 | Gibbs et al. . |
| 5,101,224 | 3/1992 | Freed, Jr. . |

*Primary Examiner*—N. Le
*Assistant Examiner*—L. Anderson
*Attorney, Agent, or Firm*—Polster, Lieder, Woodruff & Lucches

[57] ABSTRACT

A mount (9) is disclosed for mounting an ink jet printhead (11) in position to imprint indicia on a surface (7) of an object (5) conveyed along a path (3) past the printhead. The mount comprises a support (21) and a slide (53) carried by the support. The slide has a slide body (55) connected to the support, a slide member (57) movable relative to the slide body along a slide axis (SA) between an extended position (as shown in FIG. 1) and a retracted position (not shown), and device for resiliently biasing the slide member relative to the slide body toward its extended position. Mounting plate (43) is provided for carrying the slide relative to the support such that the slide axis (SA) may be adjusted relative to the support so as to position the slide axis so as to either be perpendicular to the direction of movement of the object conveyed along the path or to be angled (as shown in FIG. 3) toward the object approaching the printhead at an oblique angle. The printhead is carried by the slide member and is engageable by the object conveyed along the path such that the printhead is forced to move from its extended position toward its retracted position along the slide axis (SA) against the bias of the resilient biasing device thereby to resiliently maintain the printhead in printing relation with the surface of the object as the latter is conveyed past the printhead.

19 Claims, 5 Drawing Sheets

ADJUSTABLE SLIDE MOUNT FOR INK JET PRINT HEAD

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ink jet printers, and more particularly to a mount for accurately positioning an ink jet printhead in a desired position for imprinting information or indicia on a surface of a series of articles (e.g. boxes or packages) conveyed past the printhead. The mount of this invention maintains a predetermined spaced relationship between a printing face of the printhead and the surface of the article or substrate to be imprinted.

In conventional ink jet print apparatus used, for example, for imprinting packages or boxes conveyed along a packaging line, each printhead typically has an array of orifice nozzles or ink outlet openings from which ink is expelled in the form of droplets. The droplets are expelled in a predetermined pattern toward a side of the carton or object (or other surface) to be imprinted such that upon the ink striking the carton surface, a predetermined indicia is imprinted on the surface. For example, such ink jet printing apparatus may be used to print a variety of information (indicia) on a carton or package, such as trademarks, lot numbers, serial numbers, production dates, shipping date information, bar codes, graphics, and other pertinent information. The ink nozzles or outlets of the printhead are in communication with a supply of ink. A programmable controller regulates the operation of the valves or other well known means for forming and expelling the ink droplets so as to cause the ink to be emitted from the nozzles according to a preselected pattern so as to imprint the desired information or indicia on the surface to be imprinted.

Generally, the ink nozzles or outlets are located on a print face of the printhead with this print face being spaced a short distance (referred to as the orifice-to-substrate distance or the standoff distance) from the surface to be imprinted. Thus, ink emitted from the ink jet nozzles must travel from the printface to the surface to be imprinted across the orifice-to-substrate distance (which is typically a small fraction of an inch) to form the ink droplets of the desired shape and size and to form an ink droplet pattern of the desired resolution so as to form the indicia to be imprinted. Typically, an ink droplet grows wider as it travels from the outlet opening or nozzle to the surface to be imprinted. As the width (diameter) of the droplet increases, a larger or irregular dot will be printed upon the surface impacted by the droplet. As the droplet gets wider, the outer edges of the printed dots loose precision or resolution, and the quality of the printing deteriorates. Likewise, if the spacing of the printhead is too close to the surface to be imprinted, the droplets may not sufficiently overlap and thus the quality of the indicia to be imprinted will be adversely affected. Accordingly, the orifice-to-substrate distance of the printhead is a critical parameter in maintaining the quality of the indicia to be imprinted.

Reference may be made to U.S. Pat. No. 4,378,564 for a disclosure of a typical ink jet printing system for imprinting packages in a packaging line.

In a typical packaging line, the surfaces of cartons or other articles to be imprinted move along a conveyor path past one or more ink jet printheads. For example, the surfaces to be printed are typically the side of a carton or package being conveyed along a conveyor belt past an ink jet printing station. Of course, there are typically a series of packages one after the other that are conveyed past the print station. It is common to have one or more printheads on opposite sides of the conveyor path so that the printing can be done on opposite faces of the packages.

To guide the packages into position relative to the printhead or printheads, guide rails are commonly provided along the conveyor so as to orient and position the package on the conveyor line so that the surfaces of the packages are positioned in predetermined planes relative to the line of movement of the conveyor and relative to the print station as they move therepast. The guide rails confine the packages between them as they are transported by the conveyor.

Packages in such a packaging line are typically of the same nominal size, but they may vary in width, height, and length due to manufacturing tolerances. In addition, there may be irregularities or undulations (bulges) in the faces of the packages to be printed. Therefore, the span between the guide rails must be great enough to accommodate the widest of the packages as permitted by a range of package tolerances. Smaller packages within this permitted range of tolerances may not contact the rails. Accordingly, although the guide rails position the packages at nominal distances from the printhead, those distances vary as the packages to be imprinted are conveyed past the printheads. Further, it is generally a desire of such conveyor lines that the widest range of package tolerance possible be accommodated by the printheads. In order to achieve optimal printing quality and resolution, it is necessary that the ink jet printhead be mounted to move toward or away from the conveyor line such that the printing head may be positioned to have the optimal orifice-to-substrate distance from the surface to be imprinted, regardless of size variations of the packages to be printed and regardless of surface undulations or irregularities of the package.

Means have been developed for reducing the orifice-to-substrate distances of printheads and for maintaining a tighter tolerance of the orifice-to-substrate distances so as to enhance print quality and resolution. One such means is shown in co-assigned U.S. Pat. No. 4,814,795, which is herein incorporated by reference. In this last-mentioned patent, printheads of such ink jet printing apparatus are spring biased toward the surface to be printed so as to accommodate a range of package sizes conveyed past the printhead and so as to maintain a substantially constant orifice-to-substrate distance between the ink jet nozzles and the surface of the package to be printed. While this prior art printhead mount worked well for its intended purpose, this printhead mount required an additional separate slide mount to support the printhead. The slide mount included horizontal rods on which slide bearings were mounted which in turn carried the printhead for transverse movement of the printhead toward and away from the surface of the package to be imprinted as the package was conveyed past the printhead. The perpendicular travel of the mount relative to the conveyor caused the slide rods to be subject to being bent or peened in the operative life of the slide mount. Of course, an imperfection in one of the slide rods would impede the proper operation of the slide and would have a negative effect on print quality. Further, as the speed of the packages conveyed past the printhead was increased, the engagement of the printhead by packages at such higher speeds resulted in sudden impact loads being applied to the printhead and/or the mount which resulted in bouncing of the printhead and the mount. In turn, these impact forces and the consequent bouncing of the printhead resulted in poorer quality printing and resolution, as compared to printing at slower speeds. In addition, the impact loads, under certain conditions, could cause the printhead to de-prime (i.e.., lose its ink supply) such that is would not properly print.

U.S. Pat. No. 5,101,224, which is also assigned to the same assignee as the present invention and which is also incorporated herein by reference, solved some of the aforementioned problems. Specifically, this last noted prior art patent provided an ink jet printhead support that carried the printhead on a pivotally mounted support that was biased inwardly toward the surface of a package or article by means of a torsion spring. The support permitted vertical and horizontal positioning of the printhead, and eliminated the above noted slide rods, however, this printhead support was complex in construction and the action tended to skew the print, depending on the placement of the package relative to the pivot point. In addition, this prior art printhead support was not sufficient for higher resolution printheads.

BRIEF SUMMARY OF THE INVENTION

Among the several objects and features of the present invention will be noted the provision of a support or mount for an ink jet printhead which maintains an optimal orifice-to-substrate distance between the printing face of the printhead and a surface to be printed conveyed past the printhead;

The provision of such a printhead support or mount which permits high resolution printing of bar codes, graphics, and other indicia on packages or other substrates as the packages are conveyed past the printhead at relatively high speeds (e.g., 160 feet per minute or more);

The provision of such a printhead mount that effectively absorbs impact energy of a package being conveyed past the printhead at relatively high speed engaging the printhead mount;

The provision of such a printhead mount that smoothly absorbs such impact energy and which assures fast, but smooth movement of the printhead as the latter moves toward and away from the package surface to be imprinted, and thus prevents de-priming of the printhead;

The provision of such a printhead mount which assures a tighter range of orifice-to-substrate distance tolerances and which maintains such tolerances as the packages are conveyed past the printhead so as to maintain high resolution print quality;

The provision of such a printhead mount which allows the printhead to be positioned in a park position in which the largest package within a range of package sizes to clears the printhead as the package is conveyed therepast;

The provision of such a printhead mount which allows the printhead to be positioned in an extended print position in which the printhead mount is engaged by any package within this range of package sizes conveyed past the printhead and which positions the print face of the printhead relative to the surface of the object or package to be imprinted with a desire standoff distance (i.e., orifice-to-substrate distance) so as to enable the imprinting of high resolution indicia on the object;

The provision of such a printhead mount which permits movement of the printhead toward and away from the package surface to be imprinted with the movement of the printhead being taken up by a resilient slide or other mechanism which is operable in an angled or oblique range of directions so as to lessen impact load upon the printhead as the latter is engaged by a package conveyed along said conveyor path and as the printhead is forced from its extended position to its desired printing position; and The provision of such a printhead mount which is of rugged and economical construction, which has a wide range of operational tolerances, and which is reliable in operation and has a long service life.

Briefly stated, a mount of the present invention mounts an ink jet printhead in position to imprint indicia on a surface of an object conveyed along a path past the printhead. The mount comprises a support and a slide carried by the support. The slide has a slide body connected to the support, a slide member movable relative to the slide body along a slide axis between an extended position and a retracted position, and means for resiliently biasing the slide member relative to the slide body toward its extended position. Means is provided for carrying the slide relative to the support such that the slide axis may be adjusted relative to the support so as to position the slide axis within a range of slide angles relative to the direction of movement of the object conveyed along the path or to be angled toward the object approaching the printhead. The printhead is carried by the slide member and is engageable by the object conveyed along the path such that the printhead is forced to move from its extended position toward its retracted position with the slide moving along its slide axis against the bias of the resilient biasing means thereby to resiliently maintain the printhead in printing relation with the surface of the object as the latter is conveyed past the printhead.

Alternatively, a mount of the present invention mounts an ink jet printhead in position to imprint indicia on the surface of an object conveyed past the printhead and includes a support. A slide is carried by the support with the slide comprising a slide body connected to the support, and a slide member movable along a slide axis relative to the slide body between an extended position and a retracted position. The slide includes means for resiliently biasing the slide member relative to the slide body toward its extended position. The slide is oriented on the support such that the slide axis angles toward an approaching object to be imprinted at an oblique angle with respect to the path of the object. The printhead is carried by the slide member and is engageable by the object conveyed along the path such that the printhead is forced outwardly away from the object in such manner that the slide is forced to move from its extended position towards its retracted position along the slide axis at the above noted oblique angle. The fenced movement against the bias of the resilient biasing means thereby to lessens the impact of the printhead being engaged by the object as the latter moves into engagement with the printhead and to resiliently maintains the printhead in printing relation with the surface of the object as the latter is conveyed past the printhead.

Other objects of this invention will be in part apparent and in part pointed out hereinafter.

BRIEF DESCRIPTION OF THE SEVERAL VIEWS OF THE DRAWINGS

Corresponding reference characters indicate corresponding parts throughout the several views of the drawings.

DETAILED DESCRIPTION OF THE INVENTION

Figure 1:
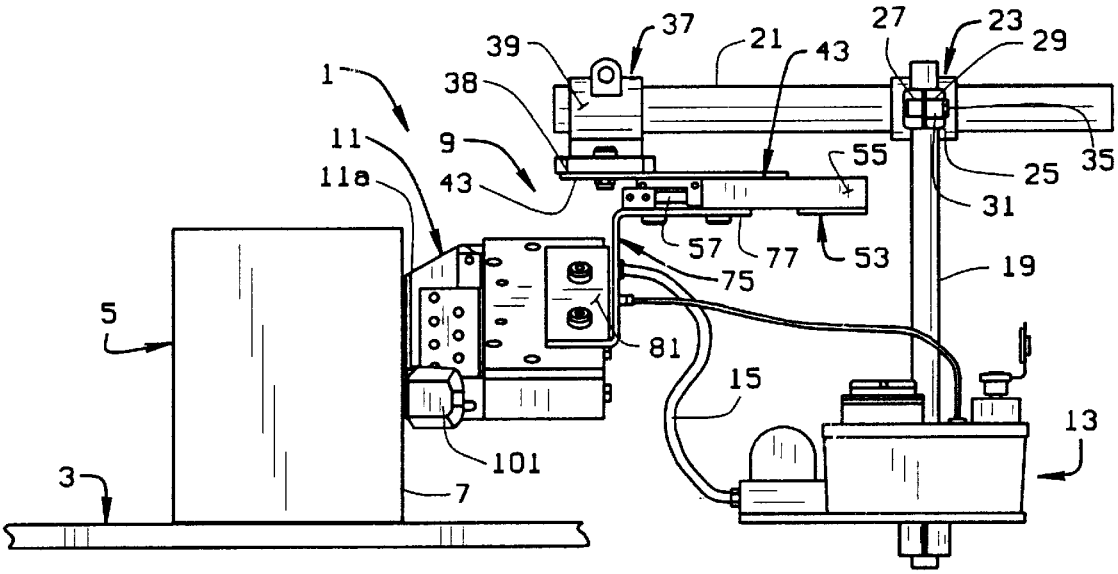
FIG. 1 is a side elevational view of a printing station along a packaging line illustrating a first embodiment of an ink jet printhead mount of the present invention for positioning an ink jet printhead so as to imprint indicia on packages or other articles conveyed on a conveyor path past the printed.

Referring now to the drawings, an ink jet printing station, as generally indicated at 1, is shown positioned along a conveyor 3 which carries a series of articles, objects, or packages, generally indicated at 5, past the printing station. Each article or package 5 (also sometimes referred to as a carton) has a surface 7 upon which selected indicia are to be printed at the printing station.

Printing station 1 includes a printhead mount of the present invention, as generally indicated at 9, which supports an ink jet printhead 11 at a desired vertical height relative to article 5 and at a proper horizontal spacing (i.e., a standoff distance) from surface 7 of article 5 so that indicia to be printed will have a clear and sharp resolution on surface 7. An ink supply system 13 is provided at printing station 1 so as to supply ink to printhead 11 through an ink line 15. The ink supply system 13 includes a controller, as is well known in the art, for controlling the flow of ink to printhead 11 and to force ink from a plurality of ink nozzles or orifices (not shown) provided in a print surface 17 of printhead 11 so as to form droplets in a predetermined pattern so as to imprint the desired indicia on surface 7 of article 5. Such ink supply system and ink jet printhead are described, for example, in U.S. Pat. No. 5,101,224, which is herein incorporated by reference. However, within the broader aspects of this invention, any ink supply and any ink jet printing system may be used.

Printhead mount 9 includes a vertical support 19 located at a desired position at print station 1. For example, support 19 may be a rigid tube mounted securely to a frame or the like (not shown). Printhead mount 9 further includes a horizontal support 21 is mounted to vertical support 19 by means of an adjustable clamp bracket 23. Horizontal support 21 is shown to be a rigid tubular member and adjustable clamp bracket 23 includes a first sleeve 25 which slidably receives horizontal support 21. Adjustable clamp bracket 23 has a second sleeve 27 which is generally perpendicular to the first sleeve 25 and which is sized so as to slidably receive vertical support 19. The second sleeve 27 has a longitudinal slit 29 therein and has a threaded boss 31 for receiving a fastener or bolt 35 so that upon tightening of the bolt, the second sleeve 27 may be clamped to vertical support 19 at any position therealong. By loosening bolt 35, adjustable clamp bracket 23 along with the horizontal support may be moved vertically along the vertical support to any desired position and then may be reclamped so as to adjust the vertical position of the printhead in desired relation to article 5 conveyed past the print station 1 on conveyor 3. As noted above, first sleeve 25 slideably receives the tubular horizontal support 21. It will be appreciated that the first sleeve 25 may by provided with a similar clamp type threaded bars securement sleeve so that horizontal support 21 may be moved horizontally relative to the vertical support and may be selectively clamped to first sleeve 25.

A second clamp bracket 37 is slidably journaled on support 21. Second clamp bracket 37 includes a base 38 and a sleeve 39. Sleeve 39 is sized to fit around horizontal support 21 and, like adjustable clamp bracket 23, sleeve 39 has a longitudinal slit 41 (see FIG. 2) and a pair of bosses 42 on either side of the slit. A bolt 44 (see FIG. 2) is threadably received in one of the bosses so as to enable sleeve 39 to be securely clamped in position on support 21. Of course, by loosening bolt 44, the second clamp bracket 37 may slide along horizontal support 21 to any desired position and then be securely clamped to the horizontal support. In this manner, printhead 11 may be properly positioned relative to cartons 5 to be printed.

A mounting plate 43 is connected to the second clamp bracket 37 by a pair of fasteners 45 which extend through corresponding fastener holes 47 in bracket base 38 and fastener holes 49 in the front of the mounting plate. A pair of nuts 51 (or other fastener means) are threaded on fasteners 49 on the underside of the second clamp bracket 37. Mounting plate 43 has a longitudinal axis, as indicated at $LA_1$ shown in FIGS. 3A, which extends generally parallel to the axis of horizontal support 29 and which is generally perpendicular to the line of movement of articles 5 on conveyor 3 (as shown by arrow A in FIG. 3A). This longitudinal axis $LA_1$ is parallel to the axis of horizontal support 21.

Figure 3A:
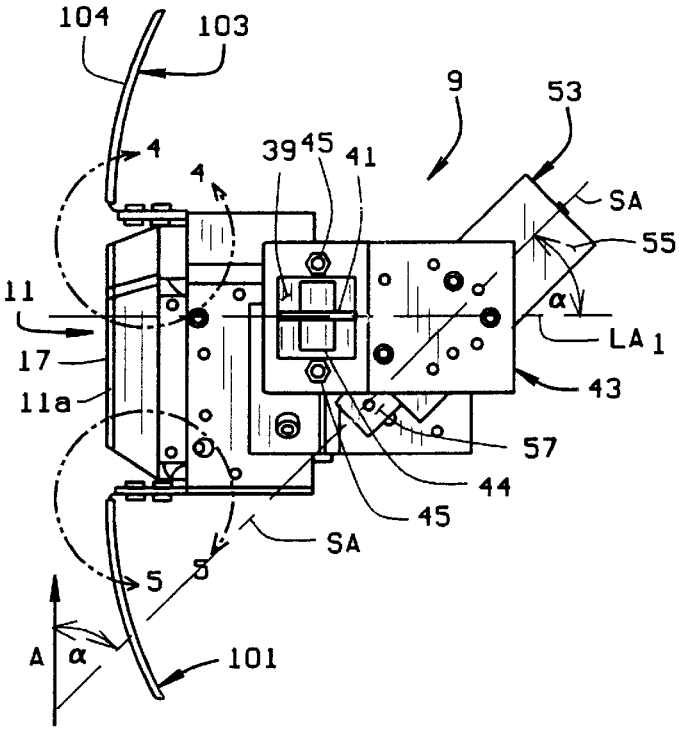
FIG. 3A is a top plan view of a portion of the printhead mount shown in FIG. 1 illustrating a printhead having a printface parallel to the surface of the package conveyed therepast and illustrating the printhead being resiliently mounted on a slide for movement of the printhead in a direction perpendicular to the direction of movement of the articles conveyed therepast with the slide being movable along a slide axis at an oblique angle with respect to the path of the articles conveyed therepast.
Figure 8:
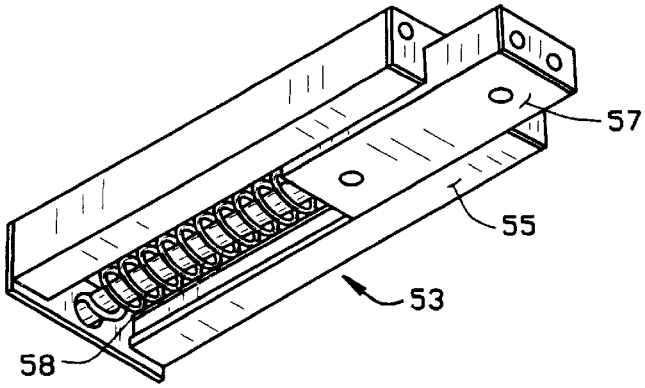
FIG. 8 is a bottom perspective view of the slide illustrating the slide body, the slide, and a spring for biasing the slide outwardly (forwardly) toward an extended position.

A slide 53, preferably a spring loaded linear ball slide, is secured to the bottom face of mounting plate 43. Slide 53 has an upper slide body 55 (see FIG. 8) which is fixed to the underside of mounting plate 43 and a slide member 57 which is movable with respect to slide body 55 in an axial direction along a slide axis SA, as shown in FIG. 3A. A spring 58 biases slide member 57 axially outwardly from slide body 53 toward an extended position, as shown in FIG. 8.

Slide 53 is preferably be a compliant preloaded ball slide such as is described in U.S. Pat. No. 4,923,311, which is herein incorporated by reference. Such ball slides are commercially available from Ball Slides, Inc., 106 Adams Street, Medfield, Mass. 02052. However, those skilled in the art will recognize that slides or of different construction may readily be employed in place of the ball slide illustrated herein. In selecting such a slide, it is preferred that the slide or other resilient mechanism have the capability of withstanding loads that are both perpendicular to and parallel to the direction of movement of the cartons along the conveyor line. In other words, the slide should be capable of handling not only axial loads along the slide axis SA (i.e., loads in the direction of movement of the slide), but the slide should also handle the side loads (i.e., loads perpendicular to the slide axis SA) that will be imposed on the slide due to the angled position in which the slide may be mounted relative to the printhead.

Preferably, but not necessarily, slide axis SA forms an oblique angle $\alpha$ with respect to the direction of movement of article 5 along conveyor belt 3, as indicated by arrow A in FIG. 3. However, within the broader aspects of this invention, the oblique angle $\alpha$ may vary considerably. In some applications, particularly with packaging lines having a conveyor speed slower than some thresh hold speed, it will be understood that slide angle SA may be perpendicular to the direction of movement of articles 5. That is, the angle $\alpha$ may be 90° . However, by having the slide axis SA at an oblique angle $\alpha$, generally as shown in FIG. 3, it has been found that such an oblique slide axis lessens the impact of an article 5 conveyed along conveyor 3 engaging printhead 11 in a manner as will hereinafter appear and insures that the slide will move through a greater distance as the printhead is forced from its extended position toward its printing position with print face 17 of printhead 11 in the desired printface-to-substrate distance for surface 7 to be printed. In turn, this allows the use of a higher resolution printhead 11 which can result in printing of higher resolution and print quality as the speed of the line is increased. By lessening of the impact forces upon an article 5 engaging the printhead at high speed, smoother operation of the printhead mount results and a more uniform quality of printing is achieved.

Figure 2:
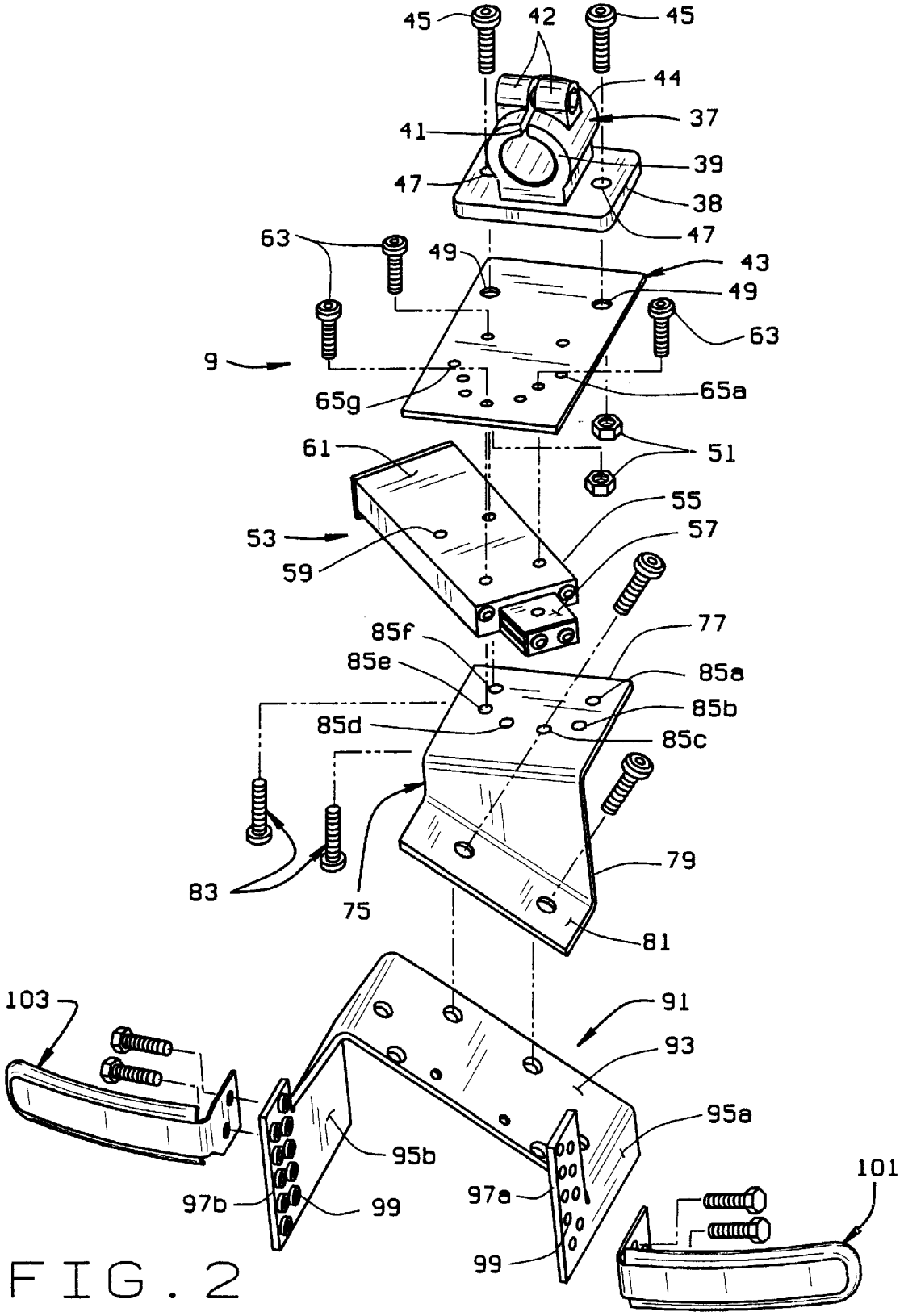
FIG. 2 is an exploded perspective view of the printhead mount of the present invention having a mounting plate, a linear slide, a bracket carried by the slide, and a bracket carrying the printhead.
Figure 6A:
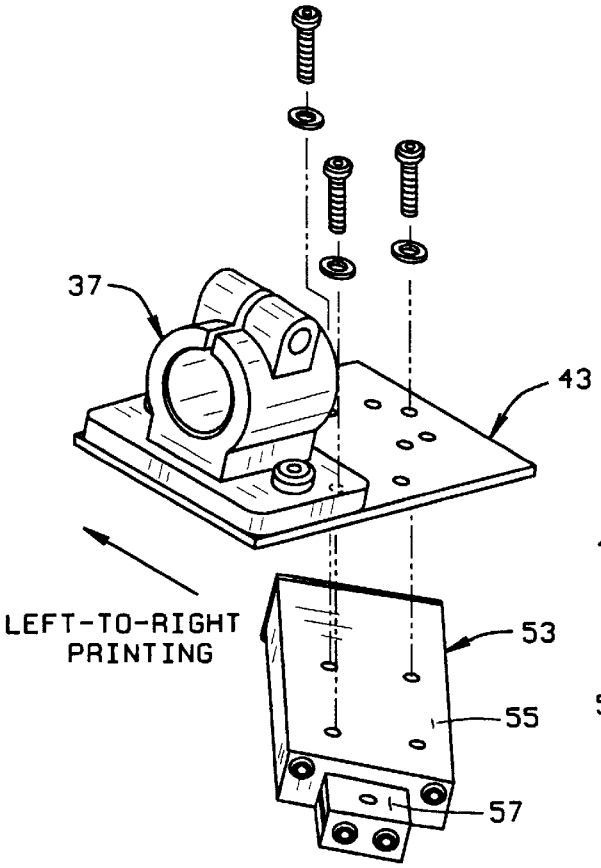
FIG. 6A is a perspective exploded view of a mounting plate and a forward biased linear slide with the slide set an oblique angle relative to the mounting plate for left-to-right printing of packages moving the direction of movement shown by the arrow.
Figure 6B:
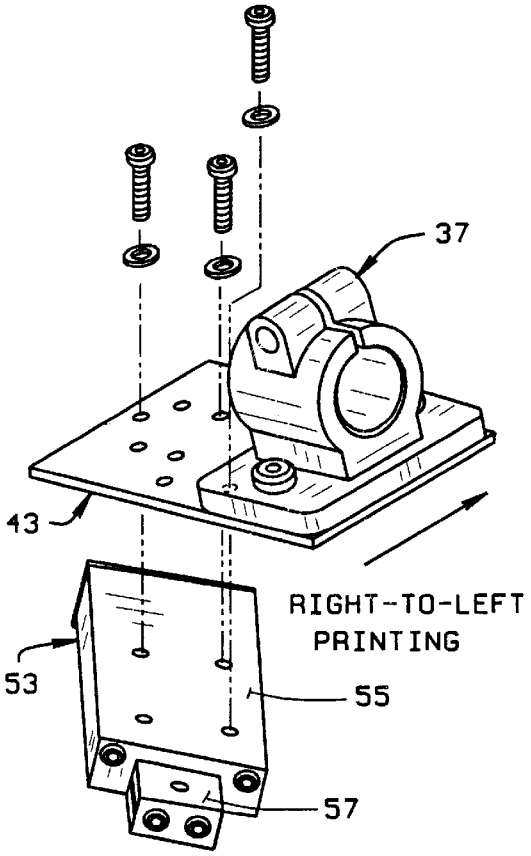
FIG. 6B is a view similar to FIG. 6A with the slide set at an oblique angle on the mounting plate for right-to-left printing of packages moving in the direction of movement shown by the arrow.
Figure 7:
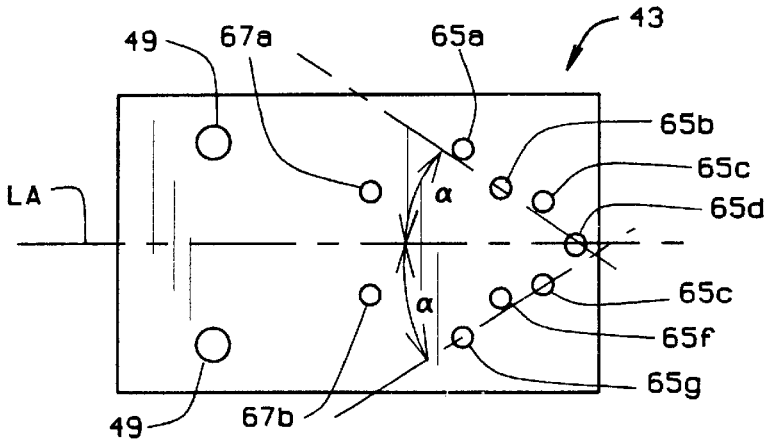
FIG. 7 is a top plan view of the mounting plate showing two series of fastener holes for mounting the slide on the mounting plate at either of two pre-determined oblique angles for either left-to-right or right-to-left printing.

More specifically, slide body 55 has a plurality of holes 59 in its upper face 61 (as shown in FIG. 2) which receive fasteners 63 extending through fastener holes 65*a*–65*g* in mounting plate 43 so as to secure the slide to the underside of the mounting plate. As best shown in FIGS. 6 and 7, mounting plate 43 has a plurality of fastener holes, as indicated at 65*a*–65*g*, and a pair of key holes 67*a*, 67*b*. Three fasteners 63 are used to mount slide 53 to the underside of mounting plate 43. One of the fasteners is inserted through one of the key holes, 67*a*, 67*b*, and the other two fasteners are inserted through two of the fastener holes 65*a*–65*g*. Fastener holes 65*a*–65*g* form corresponding pairs of holes which allow the slide to be attached to the mounting plate in a plurality of predetermined angular positions relative to the mounting plate. For example, if the fasteners are inserted through holes 65*c* and 65*g*, the mounting plate and slide axis SA will be generally parallel to the axis of horizontal support 21 so as to perpendicular to the line of motion A of articles conveyed on conveyor 3. However, if fasteners are inserted into fastener holes 65*a*, 65*c*, or 65*g*, 65*e*, then slide 53 will be set at an oblique angle $\alpha$ of about 30°. Further, if fastener holes 65*b*, 65*d*, or 64*f*, 65*d* are used, then slide axis SA will be at an oblique angle $\alpha$ of about 35°. In addition, by providing the series of angled holes shown in FIG. 7, slide 53 may either be mounted in a position, as shown in FIG. 6A, to effect left-to-right printing as the articles are conveyed past the print station in the direction shown by the arrow in FIG. 6A, or the angle of the slide 53 may be reversed, as shown in FIG. 6B, so as to print from right-to-left as the articles are conveyed past the print station in the direction shown by the arrow in FIG. 6B. Those skilled in the art will recognize that by providing preselected holes in mounting plate 43, slide 53 may be set in any desired oblique or perpendicular angle relative to the direction of movement of the articles along the conveyor.

Figure 3B:
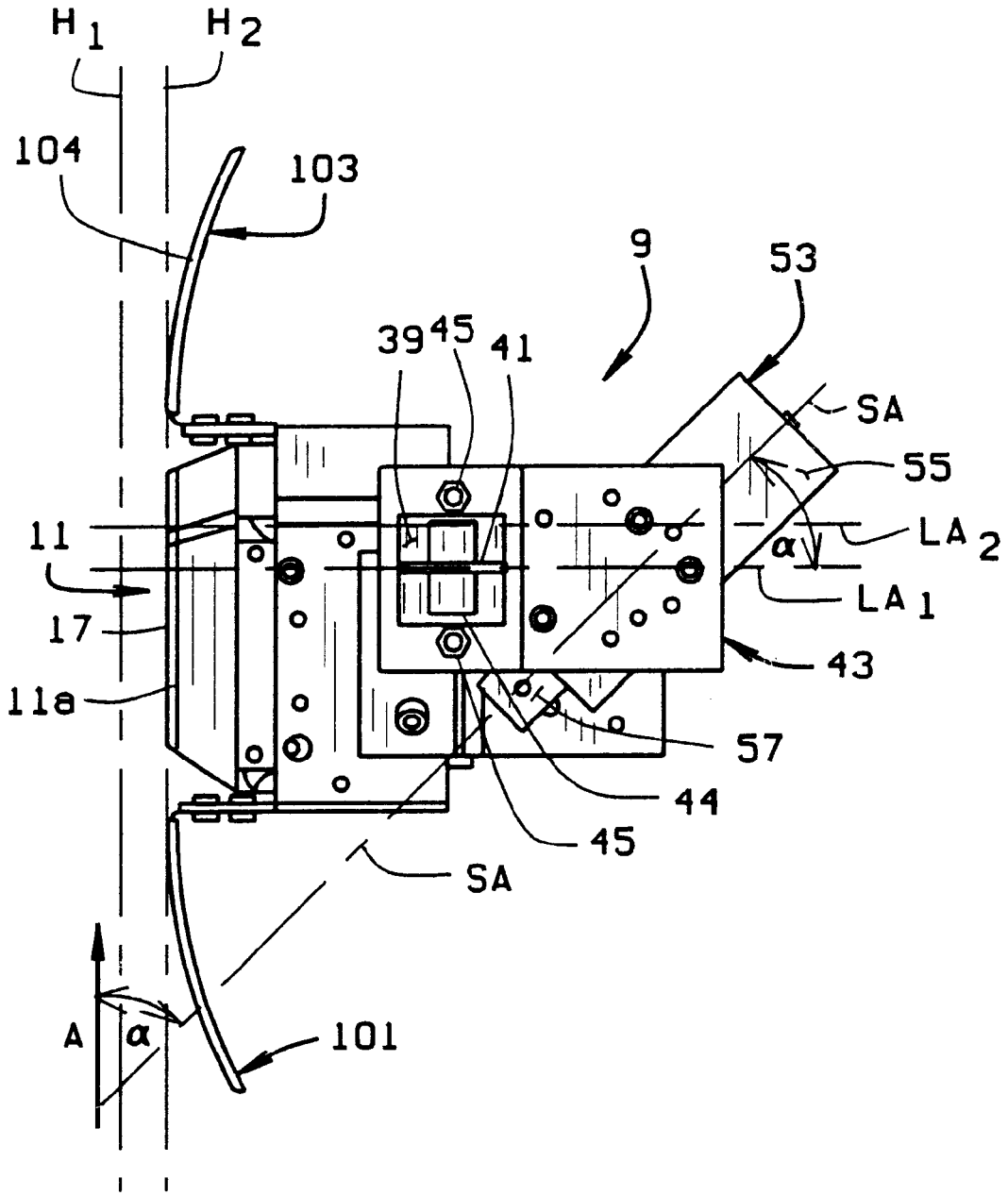
FIG. 3B is a top plan view of the printed similar to FIG. 3*a*, illustrating the position of the printhead mount relative to the slide body when the slide is in the retracted position.

The ability of being able to mount slide 53 at a predetermined oblique angle $\alpha$ relative to the direction of movement of articles 5 (hence, relative to the carton surface 7 to be imprinted) is important because it lowers the impact force of the printhead being engaged by a carton 5 being conveyed along conveyor 3 and thus allows for smoother operation of the slide between its extended position shown in in FIG. 3A and retracted position shown in FIG. 3B so as to accommodate packages of various sizes within a range of package sizes between a maximum and a minimum package size as the packages are conveyed at high speed. With slide oriented at an oblique angle relative to the path of movement of the carton, the slide will thus be forced to act through a greater distance than if the slide is perpendicular to the carton direction. As shown in FIG. 3B, in the retracted position, the printhead is displaced perpendicular to A from position $H_1$ to position $H_2$, and parallel from A from axis $LA_1$ to axis $LA_2$. This allows the impact forces to be dissipated over a greater distance and results in smoother movement of the printhead upon being engaged by a carton to be printed. Further, this oblique mounting of slide 53 results in the mount of this invention being able to maintain orifice-to-substrate distances between print face 17 of printhead 11 and the print surface 7 with a higher degree of tolerance which in turn enables printing of indicia with a higher level of printing quality and resolution. It will be particularly understood that this angled orientation of slide 7 is particularly important when the carton speed on conveyor 3 is increased, particularly at speeds that are greater than a maximum speed for the printhead. For some printheads, the speed at which the angled orientation of slide 7 is readily apparent is about 160 feet per minute (49 m./second). For other printheads, the threshold speed at which the angled slide is particularly advantageous may range from about 120 feet per second to about 200 feet per second, depending on printhead mass, the susceptibility of the printhead to de-prime, thus loosing its ability to print, and the particular design features of the printhead. While the orientation of slide 53 in a generally perpendicular position relative to the line of movement of conveyor 3 is satisfactory for speeds below a certain threshold speed for a printhead, it is generally desirable that the slide axis SA be oriented at an oblique angle, as shown in FIG. 3, for higher conveyor speeds.

A bracket 75 is secured to the bottom of slide member 57 such that brackets moves with the slide member and allows printhead 11 to be mounted within printhead mount 9. Slide member 57 has two holes in its lower face (as show in FIG. 8) which receive fasteners 83 extending through fastener holes 85*a*–85*f* in the upper horizontal leg 77 of bracket 75. Fastener holes 85*a*–85*f* form corresponding pairs of holes which allow the bracket 75 to be attached to the slide member 57 in a plurality of predetermined angular positions relative to the slide member. Those skilled in the art will recognize that by providing preselected holes in the bracket 75, the bracket may be set to hold the print head 11 at a proper printing position relative to the direction of movement of the articles 5 along the conveyor 3 regardless of the angle at which the slide 53 is mounted. Bracket 75 has an upper horizontal leg 77, a vertical leg 79, and an inclined leg 81. A printhead bracket, as indicated at 91, is fastened to inclined leg 81 of bracket 75 and printhead 11 is carried by bracket 91 in a desired inclined printing position. Printhead bracket 91 includes an inclined surface 93, a leading vertical side 95*a* and a trailing side 95*b*. Printhead 11 is secured to the underside of inclined surface 93 and thus is inclined at the same angle as inclined surface 93. The leading and trailing vertical sides 95*a* and 95*b* are generally parallel to one another and are spaced apart at distance sufficient to accept printhead 11 therebetween.

As shown in FIG. 2, sides 95*a*, 95*b* extend inwardly toward the article 5 to be imprinted beyond inclined surface 93 and have respective upright arms 97*a*, 97*b*. A plurality of fastener holes 99 are formed in each of the upright arms. A leading spring arm or spring guide 101 is mounted to arm 97*a* and a trailing spring arm or spring guide 103 is mounted to arm 97*b*. Trailing and leading spring guides 101 and 103 extend away from the bracket in a direction generally parallel to carton surface 7 to be imprinted. These spring guides preferably have a slight curve such that the outer ends of the spring guides 101 and 103 are spaced rearwardly (i.e., away from) the front of bracket 91 so as to ensure that a carton or article 5 being conveyed on conveyor 3 within its desired range of positions on the conveyor smoothly engages the leading spring guide 101 so as to effect at least some movement of printhead 11 away from its fully extended position and so that spring biased slide 53 exerts a biasing force on the printhead thereby to ensure that the printing face 17 of printhead 11 is maintained within a desired range of orifice-to-substrate distances from surface 7 to the printed. Further, spring guides 101 and 103 have curved faces which extend away form the forwardmost surface of the leading and trailing guides. Guides 97*a*, 97*b* are generally taller than spring guides 101 and 103. Thus, the spring guides may be connected to the print head bracket 91 at various vertical positions along the height of the guides so as to accommodate cartons of different heights, or different printheads. It will be appreciated that spring guides 101 and 103 resiliently are engaged by the articles to be imprinted as the articles are conveyed into and out of engagement with the printhead mount 9 of this invention and the spring guides serve to absorb some of the energy of the article as it is conveyed into engagement with the printhead mount.

Figure 4:
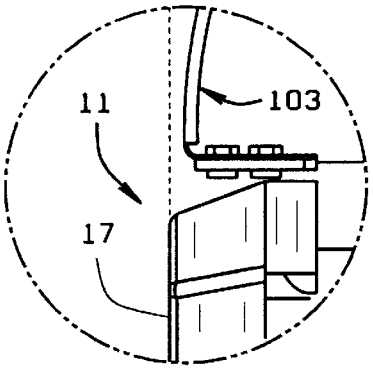
FIG. 4 is a view taken along line 4—4 of FIG. 3A illustrating a trailing spring arm or spring guide carried by a bracket mounting the printhead for engagement by a package as the package is conveyed to and past the printhead.
Figure 5:
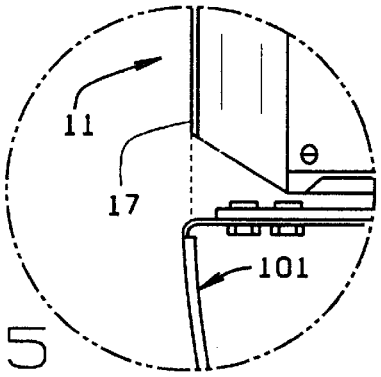
FIG. 5 is a view taken along 5—5 of FIG. 3A illustrating a leading spring arm or spring guide engageable by a package conveyed along the conveyor path as a package moves past and clears the printhead.

As can be seen in FIGS. 4 and 5, printhead 11 is mounted within printhead bracket 91 such that print face 17 extends inwardly toward carton or article 5 beyond the curved faces of spring guides 101 and 103 a short distance. This ensures that the print face 17 of printhead 11 is in close proximity (preferably in engagement with surface 7 to be imprinted). It will be appreciated that many printheads 11 have a hood or extension 1 1 a, as shown in FIGS. 1 and 2, which extends out beyond the actual print face 17 (which contains the ink orifices). With the outer edge of extension 11*a* in contact with surface 7 to be printed, it will be understood that the length of the extension thus establishes the desired standoff or orifice-to-substrate distance needed to insure that high resolution printing is maintained.

Cartons 5 travel on conveyor 3 past printhead 11 one after the other. Cartons 5 will, for each production run, be generally of the same nominal size so that the desired vertical and horizontal position of printhead 11 relative to the carton can be preset. However, even through the boxes are of the same nominal size, individual boxes within a production run will typically have a range of sizes and height and width from a smallest nominal size to a largest nominal size. In addition, the surface 7 of each of the cartons 5 to be imprinted typically will have irregularities and undulations (bulging of the carton) which must be accommodated by printhead mount 9 of this invention so as to ensure a crisp, clean and high resolution printing thereon. Mount 9 of the present invention accommodates such variations and box sizes and undulations up to about ½ inch (1.25 cm.) or more and allows printhead 11 to remain in its desired standoff distance so as to maintain the desired orifice-to-substrate distance even though the cartons or objects conveyed therepast are moving at high speed and even though the cartons have undulations, irregularities, and vary in size within a limited range.

Printhead 11 is adjusted on the vertical and horizontal supports 19 and 21, respectively, for the nominal size boxes to be imprinted. Specifically, printhead 11 and printhead mount 9 of this invention are adjusted on the vertical and horizontal support such that the print face of the printhead is vertically adjusted in register with elevation of articles 5 to be printed such that the indicia will be imprinted on the articles at a desired height. Further, the horizontal position of printhead 11 is adjusted so that its print face 17 extends somewhat into the path of the articles when slide 53 is in its fully extended position. Thus, as a carton to be imprinted moves into engagement with printhead 11, the forward edge of the carton will contact leading spring guide 101 and further movement of the carton along the conveyor will urge printhead 11 outwardly away from the path of the box from its fully extended position toward its retracted position. As can be best seen in FIG. 3, slide 53 is preferably (but not necessarily) at an oblique angle $\alpha$ with respect to the direction of travel of the conveyor, as shown by arrow A in FIG. 3. This makes the rearward movement of printhead 11 away from the carton smoother and lessens impact loads of each carton engaging the printhead. The relative position of print face 17 to the outer curve surface of leading guide 101 insures that the print face will be at a proper orifice-to-substrate distance so that the indicia will be printed neatly and clearly thereon with high resolution. As the carton passes beyond the printhead, the trailing edge of the box is engaged by trailing spring guide 103. Trailing spring guide 103 thus provides a gradual transition from the printing position of the printhead to its inwardly biased fully extended position and thus reduces or eliminates sharp and sudden movements of printhead 11 as the latter returns to its fully extended position which may de-prime the printhead Mount 9 of the present invention maintains quality printing, even when cartons 5 are skewed on conveyor 3 or when their surface 7 to be imprinted bulges outwardly. Because mount 9 preferably has linear ball slide 53 mounted at an oblique angle (especially for high speed printing) because the slide member 57 is thus forced to move through a greater distance than if the slide axis SA of the slide were oriented so as to be perpendicular to the package. Further, the mount of the present invention accommodates a relatively wide range of package dimensions and positions on the conveyor still results in high quality printing.

It is generally good practice to provide guards for preventing mis-positioned boxes or cartons from striking the side of the printhead 11 clear of the spring guides 101 and 103. A good guide rail system should be utilized so as to orient and position cartons 5 as accurately as possible on conveyor 3. It is also noted that trailing spring guide 103 is preferably mounted as high as possible on bracket guide 95*b* so as to prevent the trailing spring guide from rubbing on still wet printing laid down on surface 7 and to thus minimize smudging of the printing. Further, the provision of the obliquely mounted slide and the trailing spring guide 103 "debounces" the printhead and minimizes the chances of the printhead de-priming as it returns to its fully extended position ready to receive the next carton to be imprinted. Further, to ensure good quality printing, leading spring guide 101 is adjusted so as to be generally in line with (or forward of) print face 17 (as shown in FIG. 5) and trailing spring guide 103 is preferably adjusted so as to the space slightly rearwardly of print face 17 (as shown in FIG. 4).

Figure 9:
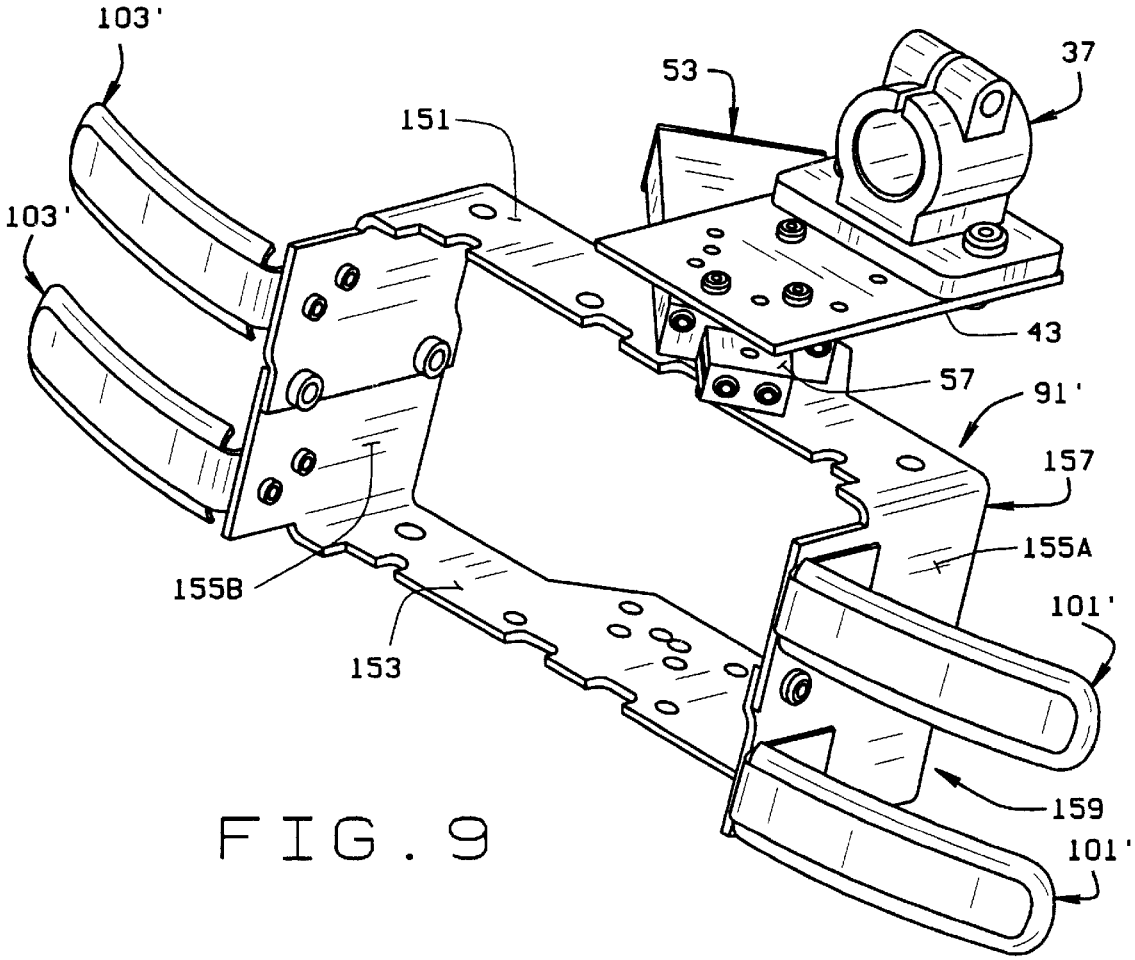
FIG. 9 is another embodiment of the bracket shown in FIG. 2 for carrying the printhead.

A second embodiment of the printhead bracket 91 is indicated in its entirety by reference character 91', as shown in FIG. 9. Like bracket 91 heretofore described, bracket 91' allows a printhead 11 to be readily mounted within the printhead mount 9 of this invention. Bracket 91' is mounted to the bottom of inner slide member 57 of slide 53 and includes a box like structure having a top 151, a bottom 153 and opposite sides 155*a*, 155*b* which are arranged so as to surround printhead 11. Bracket 91' is preferably made in a top half section 157 and a bottom half section 159. Top half section 157 forms the top 151 and the top portion of sides 155*a*, 155*b*. The bottom half 159 includes the bottom 153 and the bottom portion of the sides. Each of the sides extends out beyond the front edge of the top and bottom. The portion of each side that extends beyond the top and bottom has two pairs of fastener holes which are used to mount two leading spring guides, 101' and two trailing spring guides 103'. In general, operation of bracket 91' with a printhead 11 mounted therein is similar to operation of bracket 91' heretofore described.

In setting up a print station 1, it is necessary to determine the print direction for a particular application. Generally, print direction is determined by an observer standing behind printhead 11 as it is printing on face 7 of a carton 5 moving therepast. It should be noted whether printing is from left-to-right or from right-to-left. This will determine the orientation of slide mechanism 53 relative to mounting plate 43, as shown in FIG. 6A or in FIG. 6B.

Then, the line speed of conveyor 3 should be determined. Generally, for conveyor speeds below the above-described threshold speed (i.e., conveyor speeds of less than about 160 feet/minute), the slide axis SA may be set at a higher angle (perpendicular or nearly perpendicular) relative to the direction of travel of the cartons. However, as line speed increases, particularly at line speeds greater than about 160 feet per minute (49 m./min.), the slide axis SA is inclined relative to the axis of horizontal support 21 so as to be at an oblique angle $\alpha$, generally as shown in FIG. 3A. It will be appreciated that while the angle $\alpha$ at which the slide axis SA is obliquely angled with respect to the direction of movement of cartons 5 on conveyor 3 preferably ranges between about 20°–80°, or more. However, as the angle increases above about 45°, the advantage of having an angled slide mount for the printhead is diminished. As shown in FIG. 3, the angle $\alpha$ is about 45°. It will also be understood that while the printhead mount shown and described herein describes mounting the slide 53 in fixed positions (i.e., as determined by the location of holes 65*a*–65*g* in plate 43), a mounting plate may be provided with an infinitely variable clamp locking mechanism (not shown) such that the angle of the slide axis SA may be infinite varied. However, at the present time, the fixed position or angle of the slide as determined by the location of holes 65*a*–65*g* is preferred.

In view of the above, it will be seen that the several objects and features of this invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A mount for mounting an ink jet printhead in position to imprint indicia on a surface of an object conveyed along a path past said printhead; said mount comprising:

a support;

a slide carried by said support, said slide comprising a slide body connected to said support, a slide member movably secured to said slide body, said slide member movable relative to said slide body generally toward and away from said path along a slide axis which is at an oblique angle relative to said path between an extended position and a retracted position, said slide further comprising a spring for resiliently biasing said slide member relative to said slide body toward said extended position;

a mount bracket carrying said slide relative to said support such that said slide axis may be adjusted relative to said support so as to position said slide axis at different oblique angles relative to said path relative to said path; and said printhead being carried by said slide member and being engageable by said object conveyed along said path such that said slide and said printhead carried by said slide are forced to move from said extended position toward said retracted position along said slide axis against the bias of said spring thereby to resiliently maintain said printhead in printing relation with said surface of said object conveyed along said path past said printhead.

2. A mount for mounting an ink jet printhead in position to imprint indicia on a surface of an object conveyed along a path past said printhead; said mount comprising:

a support;

a slide carried by said support, said slide comprising a slide body connected to said support, a slide member movably secured to said slide body, said slide member movable relative to said slide body generally toward and away from said path along a slide axis which is positioned at an oblique angle relative to said path said slide member being movable between an extended position and a retracted position, said slide further comprising means for resiliently biasing said slide member relative to said slide body toward its extended position, said slide oriented on said support such that said slide axis angles toward an approaching object to be imprinted at an oblique angle with respect to said path of said object; and said ink jet printhead being carried by said slide member and being engageable by said object conveyed along said path such that said printhead is forced outwardly away from said object and such that said slide is forced to move from its extended position toward its retracted position along said slide axis at said oblique angle against the bias of said resilient biasing means thereby to lessen the impact of said printhead being engaged by said object and to resiliently maintain said printhead in printing relation with said surface of said object as the latter is conveyed past said printhead.

3. An ink jet printhead mount as set forth in claim 2 wherein said printhead has a print face, said print face being oriented so as to be generally parallel to said surface of said object to be imprinted as said object is conveyed past said printhead, and wherein with said printhead in printing relation with said surface of said object, said print face is spaced from said surface within a predetermined range of standoff distances so as to maintain a standard of print resolution, said slide resiliently maintaining said print face of said printhead within said range of standoff distances as said object is conveyed therepast.

4. An ink jet printhead mount as set forth in claim 3 further comprising means for varying said oblique angle of said slide axis with respect to said path of said object.

5. An ink jet print head mount as set forth in claim 4 wherein said support comprises a vertical support, a horizontal support carried by said vertical support, and a mounting member carrying said slide, said mounting member being adjustably movable along said horizontal support toward and away from said path of said objects conveyed past said print head.

6. An ink jet print head mount as set forth in claim 5 wherein said horizontal support is vertically adjustable on said vertical support so as to vertically position said print head in vertical relation to said surface of said object conveyed along said path.

7. An ink jet printhead mount as set forth in claim 5 wherein said means for varying said oblique angle comprises a plurality of sets of mounting holes in said mounting member such that said slide may be selectively secured to said mounting member a selected one of a plurality of fixed oblique angles with respect to said path of said objects conveyed past said printhead.

8. An ink jet print head mount as set forth in claim 5 wherein said print face of said print head is oriented within a plane generally parallel to said face of said object to be imprinted, said print face angled with respect to said vertical support so that said print head imprints said indicia on said surface at an angle as said object is conveyed past said print head.

9. An ink jet printhead mount as set forth in claim 4 further comprising a bracket carried by said slide member, said bracket carrying said printhead.

10. An ink jet print head mount as set forth in claim 9 wherein said bracket further comprises a trailing spring guide carried by said bracket with said trailing spring guide being engaged by said object conveyed past said print head thereby to prevent said print head from being biased inwardly toward said path to said extended position until said object is clear of said trailing spring guide.

11. An ink jet print head mount as set forth in claim 10 wherein said trailing spring guide has a curved surface for engagement with said object with an innermost portion of said curved surface of said trailing spring guide being spaced outwardly from said print face of said print head.

12. An ink jet print head mount as set forth in claim 12 wherein said slide is a preloaded ball slide.

13. An ink jet print head mount as set forth in claim 12 wherein said bracket has a leading spring guide carried thereby for engagement by said objects conveyed along said path into engagement with said print head for initially causing said print head to move outwardly away from said extended position and so as to position the print head in proper printing relation with the surface of said object to be imprinted.

14. An ink jet print head mount as set forth in claim 13 wherein said leading spring guide has a curved surface for engagement with said object with an innermost portion of said curved surface of said lead spring guide being generally in line with said print face of said print head.

15. An ink jet printhead mount as set forth in claim 13 wherein said bracket has means for mounting said lead and said trailing spring guides in a plurality of vertical and axial positions relative to said print face.

16. A mount for mounting an ink jet printhead in position to imprint indicia on a surface of an object conveyed along a path past said printhead; said mount comprising:

a support;

a slide carrying said print head mounted on said support, said slide being angled at an oblique angle toward said object approaching said print head as said object is conveyed along said path;

said slide being movable generally toward and away from said path along a slide axis between an extended position and retracted position;

a spring for biasing said slide toward its said extended position; and a leading spring guide carried by said printhead for engagement by an object conveyed along said path to said printhead with said leading spring guide absorbing energy as said printhead is engaged by said object and with said printhead being forced to move away from said object such that said slide is forced to retract along a path at said oblique angle.

17. A mount for mounting an ink jet print head in position to imprint indicia on a surface of an object conveyed along a path past said print head; said mount comprising:

a support, said support comprising a vertical support and a horizontal support carried by said vertical support;

a slide carried by a mounting member adjustably secured to said horizontal support, said mounting member being adjustable toward and away from said path of said object conveyed past said print head, said slide comprising a slide body secured to said mounting member and a slide member movably secured to said slide body, said slide member movable relative to said slide body generally toward and away from said path along a slide axis between an extended position and a retracted position, said slide further comprising a spring for resiliently biasing said slide member relative to said slide body toward said extended position, said slide being oriented on said support such that said slide axis angles toward an approaching object to be imprinted at an oblique angle with respect to said path of said object;

an adjustment for varying said oblique angle of said slide axis with respect to said path of said object, said adjustment comprising a plurality of sets of mounting holes in said mounting member such that said slide may be carried by said mounting member in a selected one of a plurality of fixed oblique angles with respect to said path of said objects conveyed past said print head;

said ink jet print head being carried by said slide member and being engageable by said object conveyed along said path such that said print head is forced outwardly away from said object and such that said slide is forced to move from said extended position toward said retracted position along said slide axis against the bias of said spring, thereby to lessen the impact of said print head being engaged by said object, and to resiliently maintain said print head in printing relation with said surface of said object conveyed past said print head; and said print head having a print face, said print face being oriented so as to be generally parallel to said surface of said object to be imprinted as said object is conveyed past said print head, and wherein with said print head in printing relation with said surface of said object, said print face is spaced from said surface within a predetermined range of standoff distances, said slide resiliently maintaining said print face of said print head within said range of standoff distances as said object is conveyed therepast.

18. A mount for mounting an ink jet printhead in position to imprint indicia on a surface of an object conveyed along a path past said printhead; said mount comprising:

a support;

a slide carried by said support, said slide comprising a slide body connected to said support, a slide member movably secured to said slide body, said slide member movable relative to said slide body generally toward and away from said path along a slide axis which is at an oblique angle relative to said path between an extended position and a retracted position, said slide being biased toward said extended position;

a mount bracket carrying said slide relative to said support such that said slide axis may be adjusted relative to said support so as to position said slide axis at different oblique angles relative to said path relative to said path; and said printhead being carried by said slide member and being engageable by said object conveyed along said path such that said slide and said printhead carried by said slide are forced to move from said extended position toward said retracted position along said slide axis against the bias of said spring thereby to resiliently maintain said printhead in printing relation with said surface of said object conveyed along said path past said printhead.

19. An ink jet printhead mount as set forth in claim 18 wherein said printhead has leading and said trailing spring guides that are adjustable relative to said mount bracket in vertical and axial direction relative to said printhead.

* * * * *

UNITED STATES PATENT AND TRADEMARK OFFICE

CERTIFICATE OF CORRECTION

| | | |
|---|---|---|
| PATENT NO | : | 6,050,664 |
| DATED | : | April 18, 2000 |
| INVENTOR(S) | : | Wilson, II |

It is certified that error appears in the above-identified patent and that said Letters Patent are hereby corrected as shown below:

Col. 13, Line 51
Replace "Claim 12" with -- Claim 3

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*